US007513117B2

(12) United States Patent
Garay et al.

(10) Patent No.: US 7,513,117 B2
(45) Date of Patent: Apr. 7, 2009

(54) METHOD FOR OPERATING A FURNACE

(75) Inventors: Mauricio Garay, Baden (CH); Gianfranco L Guidati, Zurich (CH); Douglas A. Pennell, Nenthead (GB); Frank Reiss, Lauchringen (DE)

(73) Assignee: Alstom Technology Ltd, Baden (CH)

( * ) Notice: Subject to any disclaimer, the term of this patent is extended or adjusted under 35 U.S.C. 154(b) by 543 days.

(21) Appl. No.: 11/185,500

(22) Filed: Jul. 20, 2005

(65) Prior Publication Data

US 2006/0040225 A1 Feb. 23, 2006

(51) Int. Cl.
*F23N 1/00* (2006.01)
*F23R 3/28* (2006.01)
*F02C 7/228* (2006.01)

(52) U.S. Cl. ..... 60/772; 60/776; 60/39.281; 60/725; 431/1; 431/114

(58) Field of Classification Search ..... 60/725, 60/772, 776, 39.281; 431/114, 1
See application file for complete search history.

(56) References Cited

U.S. PATENT DOCUMENTS

| | | | | |
|---|---|---|---|---|
| 4,859,171 | A | 8/1989 | Altemark et al. | 431/12 |
| 5,024,055 | A * | 6/1991 | Sato et al. | 60/39.281 |
| 6,059,560 | A * | 5/2000 | Richards et al. | 60/39.281 |
| 6,202,401 | B1 * | 3/2001 | Seume et al. | 60/776 |
| 6,742,341 | B2 * | 6/2004 | Ryan et al. | 60/725 |
| 6,922,612 | B2 * | 7/2005 | Nomura et al. | 700/274 |
| 6,955,039 | B2 | 10/2005 | Nomura et al. | 60/39.27 |
| 6,973,791 | B2 * | 12/2005 | Handelsman et al. | 60/725 |
| 2003/0056518 | A1 * | 3/2003 | Woltmann | 60/776 |
| 2004/0224268 | A1 * | 11/2004 | Keller et al. | 431/114 |
| 2005/0084811 | A1 | 4/2005 | Bueche et al. | 431/1 |

FOREIGN PATENT DOCUMENTS

| | | |
|---|---|---|
| DE | 216 777 | 12/1984 |
| DE | 196 36 093 | 3/1998 |
| DE | 101 04 151 | 9/2002 |
| EP | 0 262 390 | 4/1988 |
| EP | 1 286 031 | 2/2003 |
| EP | 1 327 824 | 7/2003 |
| WO | WO 2005/093326 | 10/2005 |

OTHER PUBLICATIONS

German Search Report for DE 10 2004 036 911.9 with brief translation.

* cited by examiner

*Primary Examiner*—Ted Kim
(74) *Attorney, Agent, or Firm*—Darby & Darby

(57) ABSTRACT

A method for operating a furnace with a multi-burner system for generating a hot gas is provided. The furnace has a combustion chamber with a plurality of burners, each having a fuel feed. The method includes regulating a first fuel feed to at least one of the plurality of burners as a function of pressure pulsations that occur in the combustion chamber so as to achieve a steady operation of the furnace. The multi-burner system may be a gas turbine, preferably of a power plant.

17 Claims, 2 Drawing Sheets

METHOD FOR OPERATING A FURNACE

BACKGROUND

The present invention relates to a method for operating a furnace with a multi-burner system for generating hot gas, particularly a gas turbine, preferably of a power plant.

A furnace, for example, a gas turbine, normally has a combustion chamber with multiple burners. Moreover, it is often the case that a fuel supply system is provided by means of which fuel is fed to the burners.

With an eye towards the ever more stringent regulations pertaining to the mandatory limit values for the emission of pollutants, efforts are made to operate the burners under the leanest conditions possible, that is to say, with a marked excess of oxidant, usually air. Such lean operation is able to considerably reduce particularly the formation of especially toxic $NO_x$ emissions. The lean combustion concurrently causes the combustion reaction to approach its lean extinguishing limit. Therefore, in order to keep pollutant emissions to a minimum, efforts are geared towards operating the gas turbine or its combustion chamber as close to the lean extinguishing limit as possible. For this purpose, with a conventional operating method, the fuel feed has to be adjusted as a function of various boundary conditions. The boundary conditions normally observed are, for instance, the ambient temperature, the relative humidity, the momentary air mass flow rate, which is particularly dependent on the degree of contamination of a compressor located upstream from the combustion chamber, the switching position ("ON" or "OFF") of a fuel or air preheater, the composition of the fuel currently being used and so forth. The control of the fuel supply system is particularly complex when the boundary conditions taken into account vary. For example, as a rule, the ambient temperature and/or the fuel composition tend to vary over the course of the day during operation of the gas turbine. Since the individual boundary conditions affect the stability of the combustion procedure in different ways, it is not always possible to find a setting for the fuel feed that allows a stable operation of the individual burners close to the lean extinguishing limit. In order to nevertheless ensure proper operation of the gas turbine, which is of the utmost priority in power plants used to generate electricity, it is regularly accepted that the combustion chamber is operated at a certain safety margin from the lean extinguishing limit, and consequently, the higher pollutant emissions that inevitably result from this also have to be accepted.

SUMMARY OF THE INVENTION

An object of the present invention is to provide an improved embodiment of an operating method of the above-mentioned type so that especially a safe operation of the combustion chamber close to the lean extinguishing limit is simplified or even made possible in the first place. Preferably, it should be possible to reduce the safety margin from the lean extinguishing limit that has been necessary so far.

According to the present invention, the fuel feed to the burners in the combustion chamber is regulated as a function of the pressure pulsations that occur in the combustion chamber. This means that the pressure pulsations that occur in the combustion chamber serve as a reference variable for controlling the fuel feed to the burners. In this context, the invention makes use of the realization that the pressure pulsations increase as the combustion process approaches the lean extinguishing limit. Here, however, a particularly relevant aspect is the surprising realization that, at certain characteristic frequencies, the intensity or amplitude of the pressure pulsations correlates with the distance of the combustion process from the appertaining lean extinguishing limit, namely, in a manner that is essentially independent of the boundary conditions that influence the combustion process and/or the lean extinguishing limit such as, for instance, the ambient temperature, fuel composition and relative humidity. This means that a change in the boundary conditions—causing, for example, an increase in the distance from the momentary combustion process to the lean extinguishing limit—goes hand in hand with a decrease in the pressure pulsations that occur.

The pressure pulsations can be detected in a conventional manner, which entails a comparison of a measured actual value to a predefined or adjustable setpoint, and which allows an appropriate adjustment of the fuel feed as a function of this setpoint-to-actual value comparison of the pressure pulsations. This feedback via the pressure pulsations translates into a closed-loop control circuit for the fuel feed to the burners. The operation of the gas turbines or the fuel feed to the burners is greatly simplified by the operating method according to the invention since, by taking into account the intensity or amplitude of the pressure pulsations, the boundary conditions repeatedly mentioned above that determine the distance of the combustion process to the mean extinguishing limit are automatically taken into account in the control system, without a need for their having to be explicitly monitored and/or having to be integrated into the control system for this purpose. It goes without saying that the operating method according to the invention markedly reduces the effort required to operate the gas turbine. Moreover, by properly selecting the setpoints of the pressure pulsations, the combustion chamber can be operated safely and yet very close to the lean extinguishing limit.

A particularly advantageous aspect of the operating method according to the invention is the fact that a modern combustion chamber is normally fitted with sensors to monitor the pressure pulsations anyway, so that these sensors can be employed to operate the gas turbine in the manner according to the invention, and consequently no additional costs are incurred for the instrumentation or for the implementation of the operating method according to the invention.

According to a particularly advantageous embodiment, when a predefined or adjustable maximum value of the pressure pulsations has been reached, the fuel feed to at least one burner of the combustion chamber is made richer by a predefined value. This maximum value of the pressure pulsations can be ascertained, for example, empirically, and it defines the smallest distance from the lean extinguishing limit at which stable operation of the combustion chamber can still be ensured. The stipulation of a certain value by which the fuel feed to the burner in question is to be made richer allows for a fast response of the control system and thus adherence to the smallest possible distance between the actual value and the setpoint of the pulsations.

In another embodiment, when a predefined or adjustable minimum value of the pressure pulsations has been reached, the fuel feed to at least one burner can be made leaner by a predefined value. In this embodiment, a maximum distance between the combustion reaction and the lean extinguishing limit is defined for the operation of the combustion chamber, and this maximum distance must not be exceeded. This measure ensures that the smallest possible distance from the lean extinguishing limit is maintained at all times, which leads to low emissions of pollutants.

The maximum value and the minimum value of the pressure pulsations define a pulsation window for the operation of the chamber within which window the burners of the combustion chamber are operated and which ensures a sufficient, although very small distance from the extinguishing limit and concurrently ensures compliance with low limit values for the emission of pollutants.

Other important features and advantages of the operating method according to the invention ensue from the claims, from the drawings and from the accompanying description of the figures making reference to the drawings.

BRIEF DESCRIPTION OF THE DRAWINGS

Preferred embodiments of the invention are presented in the drawings and they will be explained in greater detail in the description below, whereby the same reference numerals are used for identical, similar or functionally equivalent components. The following is shown in schematic depictions.

DETAILED DESCRIPTION

Figure 2:
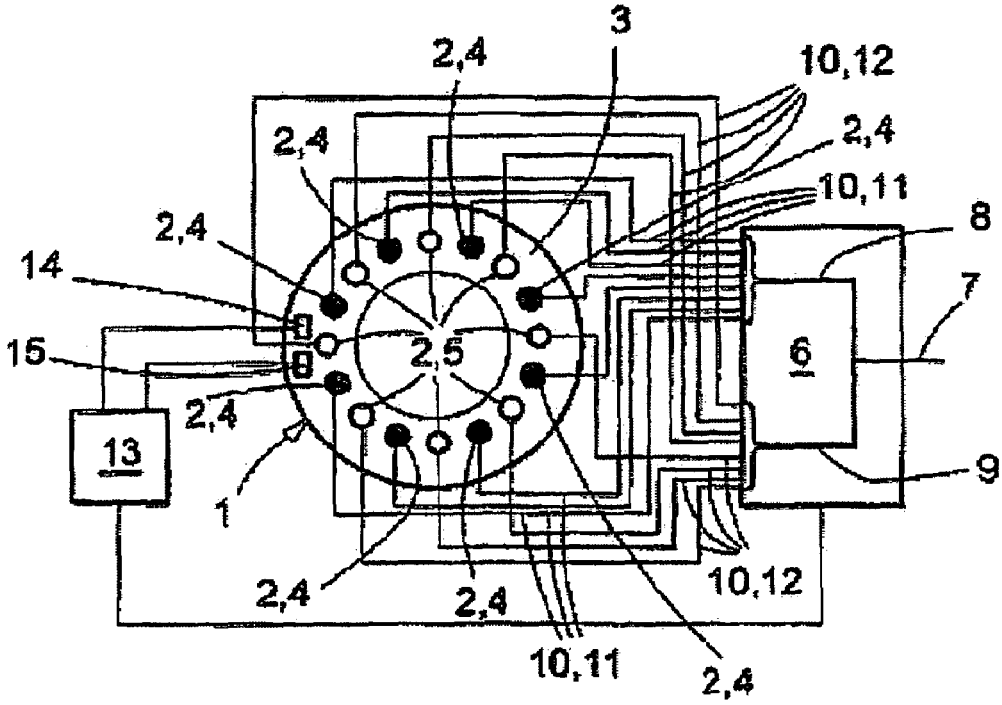
FIG. 2—a schematic of a combustion chamber depicted as a circuit-diagram.

According to FIG. 2, a combustion chamber 1 of a furnace (not shown here) is equipped with several burners 2, as a result of which a multi-burner system is created. The burners 2 are arranged here on the inlet side, for example, of an annular combustion space 3 of the combustion chamber 1. In the case of a furnace configured as a gas turbine, especially of a power plant, a compressor (not shown here) is generally located upstream from the combustion chamber 1, while the actual turbine (not shown here) is located downstream from the combustion chamber 1.

The burners 2 are divided into two groups, namely, a main group and a secondary group. The burners 2 of the main group are symbolized by solid circles here and will be referred to below as main burners 4. In contrast, the burners 2 of the secondary group are symbolized by empty circles and will be referred to below as secondary burners 5. Normally, the main burners 4 are operated with a richer feed than the secondary burners 5. Accordingly, the main burners 4 usually function at a greater distance from the extinguishing limit of the combustion reaction than the secondary burners 5. Owing to the exponential relationship that exists between $NO_x$ and the firing temperature, the main burners 4 produce considerably more $NO_x$ than the secondary burners 5 do. In contrast to the depiction selected here, the number of main burners 4 is normally greater than the number of secondary burners 5. In any case, the main burners 4 have a substantially greater influence on the combustion reaction in the combustion space 3 than the secondary burners 5 do. Therefore, the same number of burners in both groups would fundamentally be possible, for instance, if the main burners 4 and the secondary burners 5 are dimensioned differently so that they have different mass flow rates.

In order to feed fuel to the burners 2, a fuel-supply system 6 is provided which feeds a total fuel stream 7 to the burners 2 via an appropriate total line. The fuel-supply system 6 then divides this total fuel stream into a main fuel stream 8 that is associated with the main burners of the main group and into a secondary fuel stream 9 that is associated with the secondary burners 5 of the secondary group. The appertaining distribution means are not shown here. The individual burners 2 are supplied with individual fuel streams 10 by the fuel-supply system 6 via appropriate individual lines. In this context as well, a differentiation can be made between main individual fuel streams 11 associated with the main burners 4 and secondary individual fuel streams 12 associated with the secondary burners.

Furthermore, a control element 13 is provided which is coupled to the fuel-supply system 6 in order to actuate the latter and which is also coupled to at least one pulsation sensor 14 that serves to measure pressure pulsations in the combustion chamber 1 or in the combustion space 3. Moreover, the control element 13 is connected to at least one emission sensor 15 that can be employed to detect pollutant emissions in the waste gases of the combustion chamber 1 or downstream from the turbine.

According to the invention, the gas turbine is operated in such a manner that the fuel feed to the burners 2 is regulated at least so as to maintain a steady or quasi-steady operation of the gas turbine as a function of pressure pulsations that occur in the combustion chamber 1.

Figure 1:
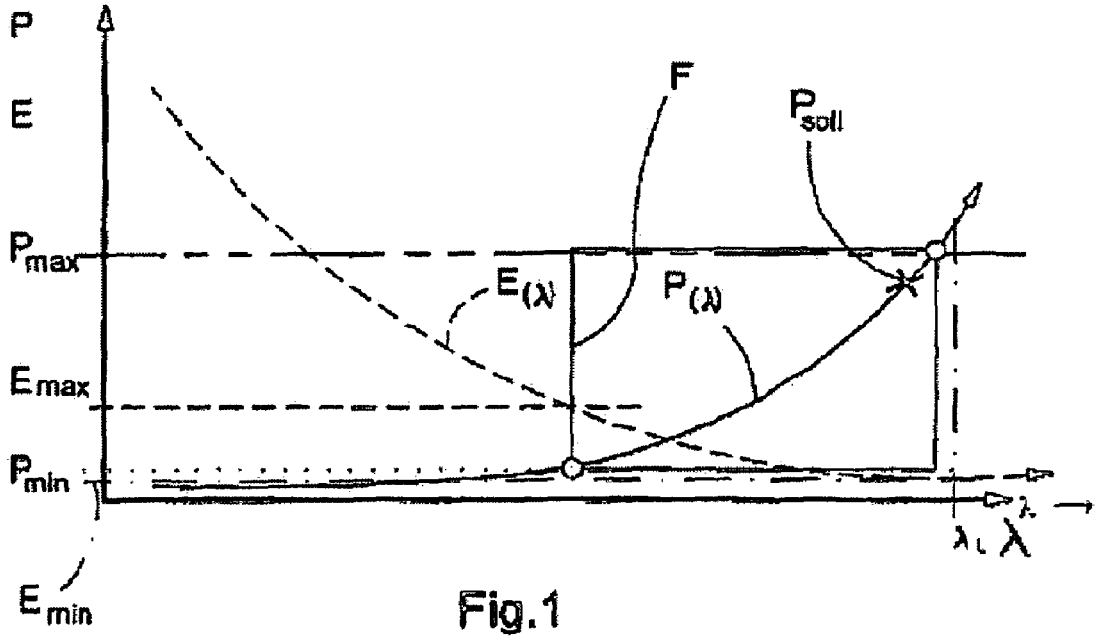
FIG. 1—a diagram in which the curves of pressure pulsations and pollutant emissions are plotted over a fuel-to-oxidant ratio.

For a better understanding of the control concept according to the invention, reference is also made to FIG. 1, whose abscissa depicts the fuel-to-oxidant mass ratio, which is generally designated by $\lambda$. The intensity or the amplitudes of the pressure pulsations P on the one hand, and the mass fractions of the pollutant emissions E in the waste gas in the combustion chamber 1 on the other hand, are plotted on the ordinate. The diagram according to FIG. 1 uses a solid line to show a pulsation curve $P_{(\lambda)}$ and a broken line to show an emission curve $E_{(\lambda)}$, each as a function of the fuel-to-oxidant mass ratio $\lambda$. Here, it can be seen that the pulsation curve $P_{(\lambda)}$ rises from the left to the right, that is to say, as the fuel-to-oxidant mass ratio $\lambda$ becomes leaner, whereas in contrast, the emission curve $E_{(\lambda)}$ falls from the left to the right as the fuel-to-oxidant mass ratio $\lambda$ becomes leaner.

The diagram according to FIG. 1 also shows a maximum value $P_{max}$ of pressure pulsations that defines a limit value for the maximally still permissible pressure pulsations P, as well as a minimum value $P_{min}$ of pressure pulsations that defines a limit value for the minimally still permissible pressure pulsations P. Furthermore, a maximum value $E_{max}$ of pollutant emissions is plotted that defines a maximally permissible limit value for the pollutant emissions. Finally, a lean extinguishing limit $\lambda_L$ of the fuel-to-oxidant mass ratio $\lambda$ is also plotted in the diagram to represent such a lean fuel-to-oxidant ratio $\lambda$ that the extinction of the combustion reaction has to be expected. Finally, a minimum value $E_{min}$ of pollutant emissions is likewise plotted.

By means of the operating method according to the invention, the gas turbine or its combustion chamber 1 can be operated very close to the lean extinguishing limit $\lambda_L$, in other words, with very low pollutant emissions and yet relatively reliably, that is to say, stably. By employing a fast-response control system, the operation of the gas turbine close to the lean extinguishing limit is considerably more reliable than conventional controls. Here, the at least one pulsation sensor 14 ascertains the intensity or the amplitude of the pressure pulsations that occur in the combustion chamber 1 and then compares this to at least one, especially empirically determined, pulsation setpoint $P_{soll}$. Therefore, the pressure pulsations P constitute a reference variable of the closed-loop control circuit established here. The fuel feed to the burners 2 is then adapted as a function of the control deviation. Since the oxidant feed, that is to say, the stream of air coming from the compressor (not shown here), generally remains constant, a change in the fuel feed has an effect on the fuel-to-oxidant ratio $\lambda$. Owing to the dependence of the pressure pulsations P on the fuel-to-oxidant ratio $\lambda$—as explained with reference to FIG. 1—a change in the fuel feed also causes a corresponding change in the pressure pulsations P. This is where the control loop closes.

Preferably, the fuel feed is regulated in such a manner that, as far as the pulsation setpoint $P_{soll}$ is concerned, a proportional control is established. In a preferred manner, the control should be carried out along the lines of a PI controller. Advantageously, the pulsation setpoint $P_{soll}$ is selected in such a way that it is as close as possible to the pulsation maximum value $P_{max}$.

According to a preferred embodiment, the operating method according to the invention functions in such a way that, when the maximum value $P_{max}$ of the pressure pulsations is reached or when the setpoint $P_{soll}$ of the pressure pulsations P is exceeded, the fuel feed to one or more burners 2 is made richer, especially by a predefined value. This means that the momentary operating point then shifts along the pulsation curve $P_{(\lambda)}$ from the pulsation setpoint $P_{soll}$ or from the point of intersection between the pressure pulsation curve $P_{(\lambda)}$ and the pulsation maximum value $P_{max}$ towards the left, in other words, in the direction of a richer feed. Since the pressure pulsations P in the pulsation maximum value $P_{max}$ have a predefined minimum distance to the lean extinguishing limit $\lambda_L$, the richer fuel feed increases the distance to the lean extinguishing limit $\lambda_L$ (towards the left).

Moreover, the operating method can be configured in such a way that, when the pulsation minimum value $P_{min}$ is reached or when the value falls below the pulsation setpoint $P_{soll}$, the fuel feed to at least one of the burners 2 is made leaner, especially by a predefined value. The result of this is that the momentary operating state then shifts along the pulsation curve $P_{(\lambda)}$ from the pulsation setpoint $P_{soll}$ or from the point of intersection between the pulsation minimum value $P_{min}$ and the pulsation curve $P_{(\lambda)}$ towards the right, in other words, in the direction of a leaner feed. In this context, the pulsation minimum value $P_{min}$ then serves to define a maximum distance to the lean extinguishing limit $\lambda_L$ which should not be exceeded in order to ensure low pollutant emissions E. As can be seen in FIG. 1, the pulsation minimum value $P_{min}$ is advantageously selected in such a way that the emission maximum value $E_{max}$ also lies approximately in this range.

Therefore, the pulsation maximum value $P_{max}$ and the pulsation minimum value $P_{min}$ define an operating window F for the operation of the combustion chamber 1 as a function of the pressure pulsations P. The combustion chamber 1 can be reliably, that is to say, stably operated within this operating window F, a process in which the smallest possible but still adequate distance from the lean extinguishing limit $\lambda_L$ can always be ensured. Furthermore, it is also achieved that the pollutant emissions E always fall between the maximum value $E_{max}$ of the pollutant emissions and the minimum value $E_{min}$ of the pollutant emissions.

Optionally, for purposes of monitoring the pressure pulsations P, the pollutant emissions E can be additionally monitored. The fuel feed to at least one of the burners 2 can also be regulated as a function of the pollutant emissions E. This especially refers to a control system with which the fuel feed to at least one burner 2 is made leaner whenever the pollutant emissions E reach the emission maximum value $E_{max}$. As a result of the leaner feed, the operating state shifts along the emission curve $E_{(\lambda)}$ from the point of intersection between the emission maximum value $E_{max}$ and the emission curve $E_{(\lambda)}$ towards the right, that is to say, in the direction of a leaner feed.

Since the emission maximum value $E_{max}$ and the pulsation minimum value $P_{min}$ are advantageously associated with the same fuel-to-oxidant ratio $\lambda$, the lower limit of the operating window F can be monitored selectively on the basis of the emission maximum value $E_{max}$ or of the pulsation minimum value $P_{min}$. However, since the absolute value of the pulsation minimum value $P_{min}$ is relatively small, measurement errors can occur, so that here the monitoring of the pollutant emissions E at certain boundary conditions can lead to more precise results. Preference, however, is given to the cumulative utilization of both reference variables, whereby the fuel feed is always made leaner whenever at least one of the two reference variables has reached its appertaining limit value, in other words, either the emission maximum value $E_{max}$ or the pulsation minimum value $P_{min}$.

By combining the two control methods, it also becomes possible to cover the case in which the relationship between the pollutant emissions E and the pressure pulsations P changes over the course of the operation of the gas turbine.

In order to make the fuel feed to the burners 2 leaner or richer, it is fundamentally possible to correspondingly raise or lower the total fuel stream 7. In particular, the fuel supply to all of the burners 2 is made richer or leaner essentially uniformly in such a case. Changing the total fuel stream 7, however, also changes the output of the gas turbine, which is not always desired under all circumstances. Rather, a gas turbine should normally be operated at a constant load. Consequently, preference is given to an embodiment in which the fuel feed to the main burners 4 is made richer in order to reduce the pressure pulsations while the fuel feed to the secondary burners 5 is made leaner. The richer feed to the main burners 4 and leaner feed to the secondary burners 5 are implemented in such a way that the total fuel stream 7 remains constant in the process. This is achieved by differently dividing the total fuel stream 7 into the main fuel stream 8 and the secondary fuel stream 9. Since the combustion process in the combustion space 3 is dominated by the main burners 4 and is thus essentially defined by these main burners 4, and since the secondary burners 5 consequently have less of an effect on the combustion process due to their smaller number and/or smaller dimensions than the main burners 4, the effects of the richer feed to the main burners 4 predominate, so that the pressure pulsations decrease.

In addition to or as an alternative to, depending on how much richer the feed is, at least one of the secondary burners 5 can be switched off and the feed to the main burners 4 can concurrently be made richer to such an extent that the total fuel stream 7 remains constant. This measure likewise causes a drop in the pressure pulsations. The above-mentioned alternatively or cumulatively employable measures for reducing the pressure pulsations P can be utilized within the scope of the operating method according to the invention in order to once again increase the distance to the lean extinguishing limit $\lambda_L$ when the pulsation maximum value $P_{max}$ is reached.

In order to raise the pressure pulsations P or to lower the pollutant emissions E, the corresponding steps can then be taken. For instance, for this purpose, the fuel feed to the main burners 4 is made leaner while the fuel feed to the secondary burners 5 is made richer, whereby the leaner and richer feeds are coordinated with each other in such a way that the total fuel stream 7 remains constant. If at least one of the secondary burners 5 is switched off when the pulsation minimum value $P_{min}$ is reached or when the emission maximum value $E_{max}$ is reached, in addition or as an alternative to the above-mentioned measure, at least one of the secondary burners 5 can be switched on while at the same time the fuel feed to the main burners 4 is made leaner to such an extent that the total fuel stream 7, once again, remains constant.

The individual fuel streams 10 can be fed to the individual burners 2 via individual lines. By the same token, separate shared feed lines can be provided for the main individual fuel streams 11 and for the secondary individual fuel streams 12, especially in the form of ring lines, from which individual supply lines then branch off to the main burners 4 and to the secondary burners 5.

Figure 3:
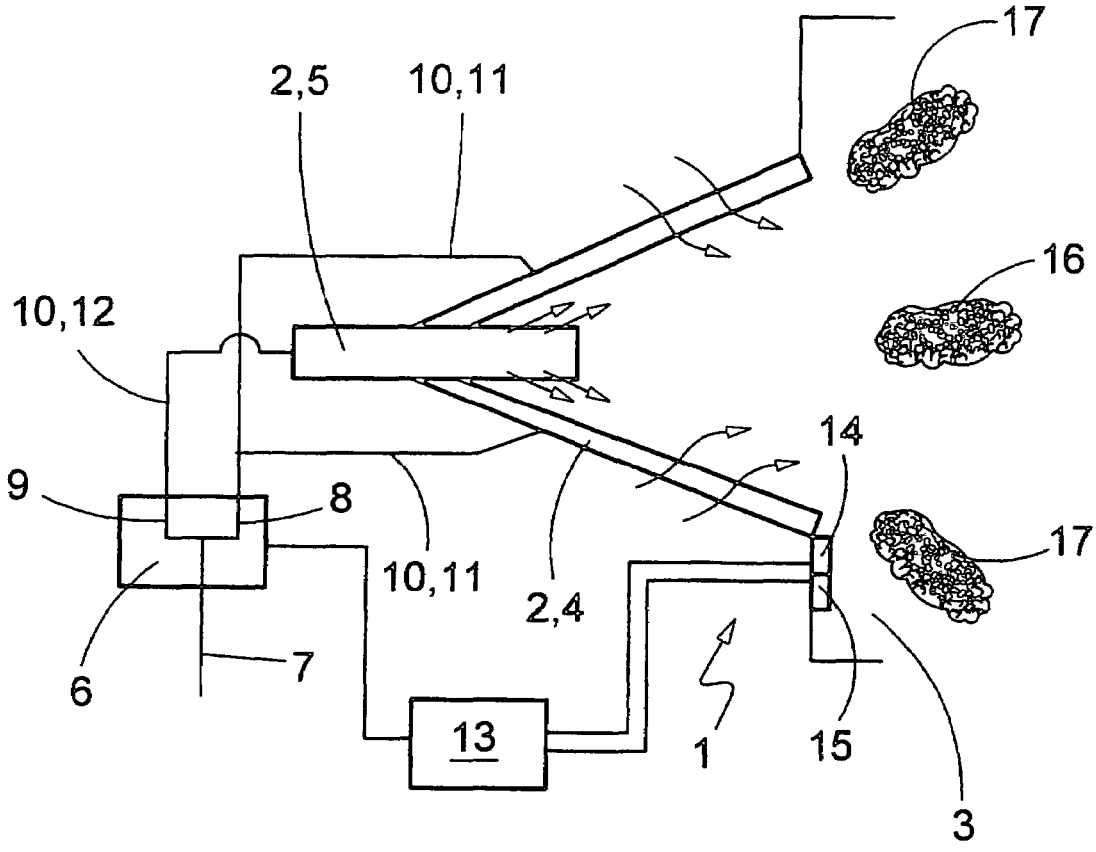
FIG. 3—a schematic like in FIG. 2, but for a different embodiment.

In the embodiment shown in FIG. 2, the individual burners 2, that is to say, the main burners 4 and the secondary burners 5, are associated with the same burner stage. It is likewise possible to associate the main burners 4 and the secondary burners 5 with different burner stages. The main group of burners 2 then forms a main stage while the secondary group of burners 2 forms a secondary stage. For example, the main stage can be a premixing stage of a premixing burner while the secondary stage is a pilot stage which can be configured, for instance, in the form of a lance in the premixing burner. Accordingly, FIG. 3 shows by way of an example a premixing burner whose premixing stage forms the main burner 4 and whose pilot stage forms the secondary burner 5. The combustion chamber 1 normally has several such premixing burners, as a result of which a multi-burner system is created. The secondary burner 5 of the pilot stage generates a pilot flame 16 that essentially serves to stabilize the flame front. In contrast to this, the main burner 4 generates the premixing stage of a premixing flame 17. Whereas the premixing flame 17 as a rule gives rise to relatively few pollutant emissions E and generates comparatively high pressure pulsations P, the pilot flame 16 causes higher pollutant emissions E at concurrently lower pressure pulsations P.

The control concept described above can also be employed without problems for the multi-stage burner principle shown here so as to allow a safe operation of the combustion chamber 1 as close as possible to the lean extinguishing limit $\lambda_L$.

LIST OF REFERENCE NUMERALS

1 combustion chamber
2 burner
3 burner space
4 main burner
5 secondary burner
6 fuel-supply system
7 total fuel stream
8 main fuel stream
9 secondary fuel stream
10 individual fuel stream
11 main individual fuel stream
12 secondary individual fuel stream
13 control element
14 pulsation sensor
15 emission sensor
16 pilot flame
17 premixing flame
P pressure pulsation
$P_{(\lambda)}$ pulsation curve
$P_{max}$ maximum valve of the pressure pulsations
$P_{min}$ minimum valve of the pressure pulsations
E pollutant emission
$E_{(\lambda)}$ emission curve
$E_{max}$ maximum value of the pollutant emissions
$E_{min}$ maximum value of the pollutant emissions
$\lambda$ fuel-to-oxidant ration $\lambda$
$\lambda_L$ lean extinguishing limit
F operating window

What is claimed is:

1. A method for operating a furnace with a multi-burner system for generating a hot gas, the furnace having a combustion chamber with a plurality of burners, the method comprising:

feeding an individual fuel stream to each of the plurality of burners using a fuel-supply system, wherein, together, the individual fuel streams form a total fuel stream, and wherein the plurality of burners include a plurality of main burners and a plurality of secondary burners;

regulating a first fuel feed to at least one of the plurality of burners as a function of pressure pulsations that occur in the combustion chamber so as to achieve a steady operation of the furnace; and wherein the regulating of the first fuel feed includes regulating a first main fuel feed to at least one main burner and a first secondary fuel feed to at least one secondary burner, and wherein, when a maximum pulsation value is reached, the first main fuel feed is made richer and the first secondary fuel feed is made leaner to such an extent that the total fuel stream remains constant.

2. The method as recited in claim 1, wherein the first fuel feed is regulated proportionally to a pulsation setpoint of the pressure pulsations, the pulsation setpoint being one of an adjustable setpoint and a predefined setpoint.

3. The method as recited in claim 2, wherein the first fuel feed is made richer when the maximum pulsation value of the pressure pulsations is reached or when the pulsation setpoint is exceeded, wherein the maximum pulsation value is one of a predefined maximum value and an adjustable maximum value.

4. The method as recited in claim 2, wherein the first fuel feed is made leaner when a minimum pulsation value of the pressure pulsations is reached or when the pressure pulsations fall below the pulsation setpoint, wherein the minimum pulsation value is one of a predefined minimum value and an adjustable minimum value.

5. The method as recited in claim 1, wherein the combustion chamber emits waste gases having pollutant emissions, and further comprising regulating a second fuel feed to at least one of the plurality of burners as a function of the pollutant emissions.

6. The method as recited in claim 5, wherein the second fuel feed and the first fuel feed are the same fuel feed.

7. The method as recited in claim 5, wherein the second fuel feed is made leaner by a predefined value when a maximum emissions value of the pollutant emissions is reached, wherein the maximum emissions value is one of a predefined emissions value and an adjustable emissions value.

8. The method as recited in claim 1, wherein, when the maximum pulsation value is reached, at least one of the secondary burners is switched off and the first main fuel feed is made richer to such an extent that the total fuel stream remains constant.

9. The method as recited in claim 1, wherein, when a predetermined condition is reached, the first main fuel feed is made leaner and the first secondary fuel feed is made richer to such an extent that the total fuel stream remains constant, wherein the predetermined condition includes at least one of a minimum pulsation value of the pressure pulsations and a maximum emissions value for waste gas pollutant emissions of the combustion chamber.

10. The method as recited in claim 1, wherein, when a predetermined condition is reached, at least one of the secondary burners is switched on and the first main fuel feed is made leaner to such an extent that the total fuel stream remains constant, wherein the predetermined condition includes at least one of a minimum pulsation value of the pressure pulsations and a maximum emissions value for waste gas pollutant emissions of the combustion chamber.

11. The method as recited in claim 1, wherein combustion chamber includes at least one burner stage and wherein the main burners and the secondary burners are associated with the same burner stage.

12. The method as recited in claim 1, wherein combustion chamber includes at least two burner stages and wherein the main burners and the secondary burners are associated with different ones of the at least two burner stages.

13. The method as recited in claim 12, wherein the at least two burner stages include a premixing stage and a pilot stage.

14. The method as recited in claim 13, wherein the main burners are associated with the premixing stage and the secondary burners are associated with the pilot stage, and wherein the first secondary fuel feed is a pilot fuel feed for generating a pilot flame.

15. The method as recited in claim 1, wherein the multi-burner system includes a gas turbine.

16. The method as recited in claim 1, wherein the furnace is a power plant furnace.

17. The method as recited in claim 1, further comprising monitoring a pollutant emission level of the furnace, and regulating a fuel feed to at least one of the burners as a function of the pollutant emission level, so that the fuel feed is made leaner when the pollutant emission level reaches a predetermined value.

* * * * *

UNITED STATES PATENT AND TRADEMARK OFFICE

CERTIFICATE OF CORRECTION

PATENT NO. : 7,513,117 B2
APPLICATION NO. : 11/185500
DATED : April 7, 2009
INVENTOR(S) : Mauricio Ernesto Garay et al.

It is certified that error appears in the above-identified patent and that said Letters Patent is hereby corrected as shown below:

In the title item (30), under Foreign Application Priority Data, please insert

-- DE 10 2004 036 911.9, July 29, 2004 --

Signed and Sealed this

Twenty-fifth Day of August, 2009

David J. Kappos

David J. Kappos
*Director of the United States Patent and Trademark Office*